United States Patent [19]

Rocco

[11] Patent Number: 4,626,221

[45] Date of Patent: Dec. 2, 1986

[54] SELFINFLATING LIFE PRESERVER

[76] Inventor: Ajello Rocco, Via XX Giugno 87, 06100 Perugia, Italy

[21] Appl. No.: 724,253

[22] Filed: Apr. 17, 1985

[30] Foreign Application Priority Data

May 22, 1984 [IT] Italy ..... 32819/84[U]

[51] Int. Cl.[4] ..... B63C 9/16

[52] U.S. Cl. ..... 441/108; 441/113

[58] Field of Search ..... 441/106, 108, 113, 114, 441/115, 117, 119, 120, 122, 123

[56] References Cited

U.S. PATENT DOCUMENTS 635,439 10/1899 Kunert ..... 441/113

2,784,426 3/1957 Boyle et al. ..... 441/113 X 3,148,393 9/1964 McCuaig ..... 441/113 X 4,360,351 11/1982 Travinski ..... 441/108 X 4,379,705 4/1983 Saotome ..... 441/108 X

FOREIGN PATENT DOCUMENTS 2068846 8/1981 United Kingdom ..... 441/113

*Primary Examiner*—Sherman D. Basinger

[57] ABSTRACT

A life preserver of the invention comprises a belt having an inside longitudinal pocket containing a double humped bladder, the bladder being inflatable by an automatic inflating device. The belt is provided with fastening portions allowing its extension when the bladder is inflated.

10 Claims, 6 Drawing Figures

SELFINFLATING LIFE PRESERVER

BACKGROUND OF THE INVENTION

The present invention relates to a self-inflating life preserver particularly suitable for water sports as well as an emergency implement for use in aircraft, lifeboats, motor boats, and the like.

Known self-inflating jacket-type life preservers are provided with straps and similar means for holding it in position on the body of the user. The buoyancy of such preservers, which are usually employed in water sports, is assured by suitable floating material, such as the cork jacket life preservers.

Known life preservers are cumbersome and, when worn, hamper the movements of the user. They further require some time to put on due to the difficulty of fastening the straps and similar means.

SUMMARY OF THE INVENTION

An object of the present invention is to provide a life preserver which embodies the advantages but avoids the drawbacks of the conventional life preservers.

Another object of the invention is to provide a life preserver which can be worn by the user in deflated condition at the level of the waist so as not to hamper movements.

A further object of the invention is to provide a life preserver which is able, when inflated, to comfortably hold the user's head out of the water level.

An additional object is to provide a life preserver which can be rapidly put on in emergency.

The life preserver of the present invention comprises a belt having an inside longitudinal pocket containing a double hump deflated bladder, the bladder being inflatable by an automatic inflating device and means being provided for allowing the extension of the belt when the bladder is inflated.

The life preserver itself, both as to its construction and its mode of operation, together with additional features and advantages thereof, will be best understood by the following detailed description of a specific embodiment with reference to the accompanying drawings.

DESCRIPTION OF THE PREFERRED EMBODIMENT

Figure 1:
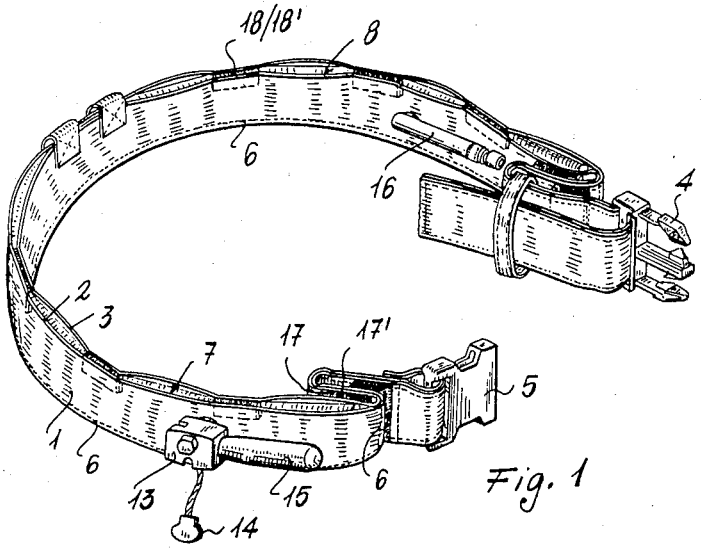
FIG. 1 is a perspective view of the life preserver of the invention.
Figure 2:
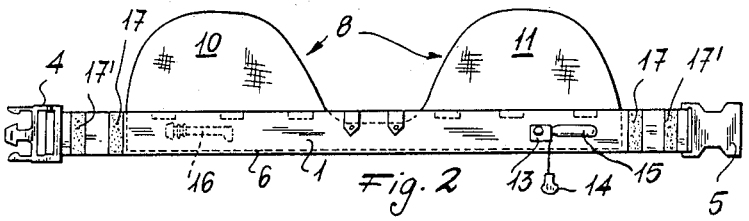
FIG. 2 is a front view of the life preserver with bladder extracted from the pocket.
Figure 3:
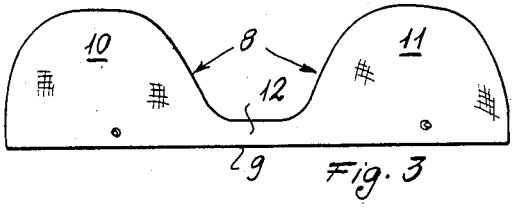
FIG. 3 shows the bladder.

The life preserver comprises a belt 1 comprised of a suitable material, having a front side 2 and a back side 3. The belt 1 is closed by coupling together a male buckle 4 and a female buckle 5. The front and back sides are sewn together by means of a sewing line 6 running along the lower edge of the belt 1 and up to the ends of the belt so as to define a longitudinal pocket 7 in which a deflated and folded bladder 8 is accommodated.

The bladder 8 is comprised of a suitable air impervious material. It's lower edge 9 is secured to the bottom of the longitudinal pocket 7. The bladder 8 is formed by two humps 10 and 11 interconnected by a section 12, the humps being directed away from the lower edge 9 and towards the opening of the pocket 7.

The hump 11 is connected to a CO2 inflating device 13 fastened to the front side 2 of the belt. The device 13 has a cord 14 operating a pin valve provided inside the device 13. A small CO2 cylinder 15 is screwed to the device 13. The hump 10 is connected to a mouth inflating device 16 fastened to the back side 3 of the belt.

Close to each end, the belt 1 is provided with fastening portions 17, 17' adapted to be engaged together to temporarily shorten the total length of the belt 1. These fastening portions can be of Velcro material as shown, or they may be comprised of press-buttons. Fastening portions 18, 18' are provided inside the longitudinal pocket 7 along the upper edges thereof to hold the pocket 7 closed when the folded and deflated bladder 8 is contained therein.

Figure 4:
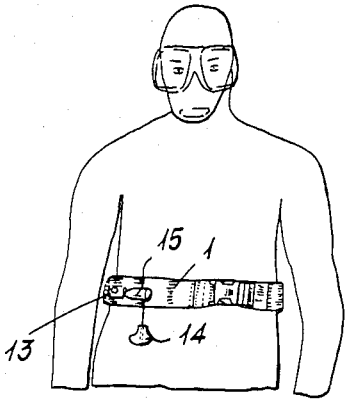
FIG. 4 shows the life preserver worn at waist level by a user.

In the operation, the belt 1 is worn by the user at waist level (FIG. 4) with the portions 17, 17' and 18, 18' fastened and with the deflated bladder 8 folded and inserted into the pocket 7. In order to adapt the belt 1 to the user's waist, the buckle 4, 5 is conventionally regulated.

The life preserver of the invention does not hamper the movements of the user so that it can be used, for example, when swimming, sailing and diving. Should the life preserver of the invention be used as part of the safety equipment in an aircraft, the buckle 4, 5 can be rapidly closed.

Figure 5:
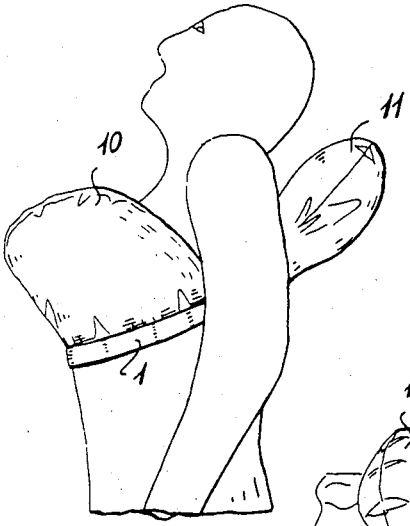
FIG. 5 shows the life preserver slipped up under the user's armpits.
Figure 6:
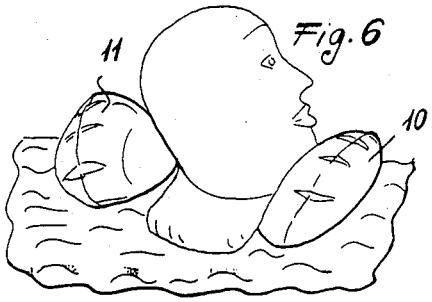
FIG. 6 shows the life preserver holding the head of the user out of the water.

In an emergency and when the user is in the water, the cord 14 is jerked and the bladder 8 automatically inflated. The increasing volume of the bladder 8 causes the portions 17, 17' and 18, 18' to snap open thus allowing the bladder 8 to project from the pocket 7. Due to the buoyancy created by the inflated bladder, the belt 1 rises from the waist level up to the under the armpits (FIG. 5). The humps 10 and 11 will now rest under the user's chin and nape of the neck respectively thus holding the head out of the water. (FIG. 6).

The invention is not limited to the precise configuration described above.

What is claimed is:

1. A life preserver comprising:

a belt having a front side and a rear side, each side having upper, lower and side edges, the sides being fixed together near the lower edges thereof to define a pocket therebetween which is open at the upper edges, the belt further comprising a buckle at its side edge to permit fastening thereof;

a bladder member located in the pocket and comprising a pair of humped portions;

inflating means for inflating the bladder member, the bladder member being substantially contained in the pocket when in a deflated condition and extending from the pocket when inflated so as to support a wearer thereof; and fastening means for maintaining the belt in a shortened position when the bladder is deflated, the inflation of the bladder causing the fastening means to unfasten to extend the length of the belt.

2. A life preserver according to claim 1, wherein said bladder has a lower edge fastened between the lower edges of the front and rear sides of said pocket.

3. A life preserver according to claim 1, wherein said humps are interconnected through a common section.

4. A life preserver according to claim 1, wherein said fastening means for maintaining the belt in a shortened position comprises Velcro portions.

5. A life preserver according to claim 1, wherein said inflating means comprises an automatic inflating device.

6. A life preserver according to claim 5, wherein said inflating device is of $CO_2$ pin valve jerking type.

7. A life preserver according to claim 1, wherein fastening portions are provided inside said longitudinal pocket along the upper edge thereof.

8. A life preserver according to claim 1, wherein said buckle is a male-female snap type buckle.

9. A life preserver according to claim 1, wherein said fastening means for maintaining the belt in a shortened position comprises one or more snap-together buttons.

10. A life preserver comprising:

a belt having front and rear sides fixed together near lower edges thereof to define a pocket therebetween, the pocket having an open upper end, the belt further comprising a buckle to permit fastening thereof around the waist of a wearer;

a bladder member located in the pocket and comprising a pair of humped portions;

inflating means for inflating the bladder member, the bladder member being substantially contained in the pocket when in a deflated condition and extending from the pocket when inflated so as to support the wearer; and fastening means for maintaining the belt in a shortened position when the bladder is deflated so that the belt is securely located around the waist of the wearer, the inflation of the bladder causing the fastening means to unfasten to extend the length of the belt thereby permitting the belt to rise to a position around the chest and under the armpits of the wearer, the humped portions projecting from the pocket to support the chin and nape of the neck of the wearer.

* * * * *